US008287146B2

(12) United States Patent
Hysky

(10) Patent No.: US 8,287,146 B2
(45) Date of Patent: Oct. 16, 2012

(54) FOAM PART AND SOUND ABSORBER WHICH IS MOUNTED IN A SUSPENDED MANNER

(75) Inventor: Johannes Hysky, Leichlingen (DE)

(73) Assignee: pinta acoustic GmbH, Maisach (DE)

( * ) Notice: Subject to any disclaimer, the term of this patent is extended or adjusted under 35 U.S.C. 154(b) by 445 days.

(21) Appl. No.: 12/589,453

(22) Filed: Oct. 23, 2009

(65) Prior Publication Data

US 2010/0110674 A1 May 6, 2010

(30) Foreign Application Priority Data

Oct. 27, 2008 (DE) ..... 20 2008 008 896 U

(51) Int. Cl.
*F21V 33/00* (2006.01)
*G10K 11/16* (2006.01)

(52) U.S. Cl. ..... 362/234; 362/253; 362/147; 181/211

(58) Field of Classification Search ..... 362/234, 362/253, 145, 147, 148, 800; 181/141, 211, 181/284, 290
See application file for complete search history.

(56) References Cited

U.S. PATENT DOCUMENTS

| | | | | |
|---|---|---|---|---|
| 4,330,691 | A * | 5/1982 | Gordon | 381/335 |
| 6,073,722 | A * | 6/2000 | Babuke et al. | 181/30 |
| 6,845,841 | B2 * | 1/2005 | Smith et al. | 181/207 |
| 7,571,790 | B2 * | 8/2009 | Kim | 181/293 |
| 2003/0029670 | A1 * | 2/2003 | Smith et al. | 181/207 |

FOREIGN PATENT DOCUMENTS

| | | |
|---|---|---|
| DE | 1 214 850 | 7/1958 |
| DE | 81 26 423 | 1/1982 |
| DE | 295 20 619 | 3/1996 |
| DE | 200 07 958 | 9/2000 |

* cited by examiner

*Primary Examiner* — Bao Q Truong
(74) *Attorney, Agent, or Firm* — Collard & Roe, P.C.

(57) ABSTRACT

The invention relates to a foam part (1), in particular for suspended arrangement in a room, for example for use as a sound absorber (2), with an acoustic region of the foam part which has an outer contour being illuminated by a lighting element (11), further with the lighting element (11) being mounted on the foam part (1) and being disposed within the outer contour of the foam part (1). In particular, the invention also relates to a foam part (1) which is fixed, as a sound absorber (2), in a suspended manner to a room ceiling (3) or room wall, a lighting element (11) which is mounted on the sound absorber (2) and illuminates a subregion of the foam part (1), being provided in said foam part.

13 Claims, 8 Drawing Sheets

FOAM PART AND SOUND ABSORBER WHICH IS MOUNTED IN A SUSPENDED MANNER

CROSS REFERENCE TO RELATED APPLICATIONS

Applicants claim priority under 35 U.S.C. §119 of German Application No. 20 2008 008 896.8 filed on Oct. 27, 2008.

The invention relates, in first instance, to a foam part, in particular for suspended arrangement in a room, for example for use as a sound absorber, with an acoustic region of the foam part, which has an outer contour, being illuminated by a lighting element.

The invention also relates to a sound absorber which is mounted in a suspended manner on a room ceiling or a room wall and is based on a foam part.

Foam parts and sound absorbers of the type under discussion are known. They serve to absorb sound when suspended from a room ceiling and/or from a room wall, in particular in reconstructed rooms. Foam parts which have, for example, the shape of an elongated rectangle in cross-section and further are arranged, for example, in parallel rows with respect to one another are used for this. DE 12 14 850 B discloses disposing a light source above a foam part and beneath a cover plate which is located above said foam part.

With respect to the cited prior art, it is an object of the invention to form a foam part and a sound absorber which is advantageous in terms of lighting.

This object is achieved, in first instance, by the subject matter of claim 1, which involves the lighting element being mounted on the foam part and being disposed within the outer contour of the foam part. The object is also achieved by the subject matter of claim 2, this concerning a lighting element which is mounted on the foam part or on the sound absorber and illuminates a subregion of the foam part. With regard to the foam part, provision is generally made for a lighting element to be integrated into this foam part.

Said lighting element can be directly mounted together with the foam part. A separate lighting mount is not required. A connection cable can be routed out of the foam part at a suitable point. Only this connection cable has to be further connected electrically. Since the lighting element is also provided within the outer contour of the foam part, it is protected. Furthermore, it is also integrated in a manner which is advantageous in terms of acoustics. The outer contour in this case is, in particular, in first instance, an enveloping line. Possible set-back regions or recesses with respect to an enveloping line of this kind can be used, for example, to accommodate a lighting element. With regard to the subject matter of claim 2, it is pertinent that a sound absorber based on a foam part, which is mounted in a suspended manner, is equipped, at the same time, with a lighting element which illuminates a subregion of this foam part. This also results in the integrated design of the sound absorber and lighting element addressed in principle above. On account of the suspended arrangement, the associated arrangement which is advantageous in terms of acoustics is on the one hand maintained. On the other hand, a lighting effect can also be achieved at a suitable point in a room in a flexible manner. The function of a light source is integrated in each case. A foam part of this kind, or specifically said sound absorber, can be used not only to illuminate rooms but, for example, to illuminate paths. The foam part or the sound absorber at the same time has the function of a lighting element carrier, so that by disposing the foam part or the sound absorber on a ceiling, the lighting source is also fixed at the same time. By virtue of a subregion of the foam part being illuminated, glare from direct light is counteracted. The light appears diffuse.

Other features of the invention are explained below, also in the description of the figures, often in their preferred association with the subject matter of claim 1 or of claim 2 or with features of further claims. They may, however, also be of importance in association with just individual features of claim 1 or of claim 2 or of the respective further claim, or in each case independently.

With regard to the arrangement of the lighting element within an outer contour of the foam part, the contour of the sound absorber is preferably provided solely by the foam part. The contour is not influenced by the arrangement of the lighting element. Within the scope of the characterizing feature that the lighting element is arranged within the outer contour, it can also be part of the outer contour. This also provides the possibility of association of foam parts or sound absorbers without lighting elements with those comprising lighting elements, this further being, in particular, in linear arrangement one after the other, with facing cross-sectional areas of the foam parts resting one against the other. On account of the arrangement of the lighting elements within the outer contour, it becomes possible to arrange foam parts with or without lighting elements one after the other without any mismatch.

In addition, it is proposed that the lighting element is surrounded, in cross-section, on all sides by foam. Therefore, a cavity which is surrounded, in cross-section, by foam, is provided within the foam part, the lighting element being situated in said cavity. In a further preferred configuration, this cavity terminates freely at the end in relation to a longitudinal extent of the foam part, and accordingly opens toward the surrounding region. A surface which delimits the opening, for example the base surface or the top surface, carries the lighting element that is accommodated. By virtue of the arrangement of the lighting element surrounded, in cross-section, on all sides by foam, a diffuse illumination through the foam material is achieved, therefore further preferably through the foam regions surrounding the lighting element which preferably have a lesser material thickness than a least cross-sectional width of the foam. Therefore, the foam wall portions which surround the lighting element, preferably the foam portions which are at the side when viewed transverse to the longitudinal extent of the foam part, are provided with a material thickness which corresponds to a third to a twelfth, preferably a fifth to a tenth, of the least cross-sectional dimension. In a preferred configuration, the same also applies to a base region of the foam which covers the lower side of the lighting element. Accordingly, the lighting element is preferably disposed in the cross-sectional region of the foam part which is directed away from the connection region of the foam part to the ceiling or wall and which is disposed so as to face downward when arranged suspended on the ceiling.

In one development, the, in particular diffuse, illumination of the region surrounding the foam part is assisted by the foam being an open-cell foam, further preferably a flexible, open-cell melamine resin foam.

Particularly in a configuration in which the lighting element is surrounded, in cross-section, on all sides by foam, a development in which a folding wall is formed on the foam part for the purpose of introducing the light element into the foam part proves advantageous. Following corresponding pivoting-out of the folding wall, this opens the accommodation region for the lighting element. In a preferred configuration, the folding wall or a subregion of said folding wall forms one of the lateral boundaries of the accommodation space that receives the lighting element.

It becomes possible to fold the wall on account of the, in particular flexible, configuration of the foam material, so that an integral, single-material configuration of the folding wall with the foam part is made possible. In a preferred configuration, the folding wall extends over the entire length of the foam part and over the entire height of the foam part as viewed transverse to the longitudinal extent, the closed position of the folding wall also being secured after insertion of the lighting element. This can be achieved by adhesively bonding the folding wall to the foam base body. A reversible configuration in which mounting of the foam part on the ceiling is used to fix the folding wall is preferred. In this case, for example, clamping strips into which the foam part is inserted and held in a clamped manner are used.

In a further configuration, the foam part has a profiled portion in the region of the lighting element. In a preferred configuration, this profiled portion is formed to be open toward the outside, therefore, in particular as viewed in cross-section, so as to extend inward starting from an outer contour of the foam part. In this case, the lighting element is disposed within the profiled portion, accordingly also within an outer contour of the foam part in this case. On account of the profiled portion with an open edge and the arrangement of the lighting element within the profiled portion, diffusely acting illumination of the surrounding region through the foam and/or indirect illumination of the surrounding region can be provided depending on the selected arrangement of the lighting element.

In a preferred configuration, the profiled portion has an undercut which is such that the profiled portion, starting from a profiled portion opening which is associated with the outer contour as viewed in cross-section of the foam part, terminates at an acute angle to a plane which runs parallel to the ceiling plane or to the connection plane of the foam part so as to face inward, with, furthermore, a rear wall which delimits the profiled portion running parallel to the side wall which has the profiled portion opening. In a further preferred configuration, the cross-section of the profiled portion slopes downward in relation to the parallel plane (horizontal plane) in the direction of the free end face of the foam part which faces downward in the position in which the part is associated with the ceiling. The lighting element is further preferably disposed on one of the faces of the profiled portion which are inclined in relation to the horizontal parallel plane, further preferably on the lower face of the profiled portion, that is to say the face of the profiled portion which faces the lower free end face of the foam part, and accordingly the lighting element is disposed in a recessed manner in relation to the lateral opening of the profiled portion. On account of this configuration, the lighting element is not directly visible. Indirect illumination is provided. Glare is counteracted. Depending on the arrangement of the lighting element and the configuration of the profiled portion, a diffuse light is provided by means of the lighting element with light shining through adjacent foam regions and/or indirect illumination is provided by illumination of opposite foam subregions and reflection. A reflection of this kind can be further assisted by appropriate arrangement of a reflection foil, for example an aluminum foil.

A particularly low-maintenance solution provides for the lighting element to comprise an LED. In this case, both white and, possibly in combination, colored LEDS can be used. In a preferred configuration, a plurality of LEDs, which are further preferably disposed at uniform distances from one another, are provided over the length of the foam part and accordingly over the length of the profiled portion or of the accommodation region which is surrounded, in cross-section, on all sides by foam. In this context, it further proves advantageous when the lighting element comprises an LED strip. The latter has LEDS which are provided arranged one after the other and are electrically connected to one another. An LED strip of this type can be fitted in an advantageous manner from a handling point of view, so that it is possible to retrofit a foam part which is provided with a profiled portion or an accommodation space which can be opened by folding open. An LED strip has, at the end, a connection cable for the supply of electrical power. Plug-type contacts are preferably provided opposite from said connection cable in the longitudinal extent of the LED strip for the purpose of direct electrical contact-connection of further LED strips in further foam parts which are disposed downstream of the foam part.

In a further configuration, provision is made for two lighting elements which are separated by a foam region to be provided, relative to a vertical longitudinal plane. Accordingly, these lighting elements are associated with side walls as viewed in the longitudinal extent of the foam part, so that illumination to the side, and possibly also downward, is provided. This is the case particularly with an arrangement of the lighting elements within a profiled portion with a preferably open edge. Therefore, provision is further made for the two lighting elements to be disposed opposite from one another, and furthermore with mirror-image symmetry with reference to a vertical plane.

In the case of an arrangement of two, and possibly more, lighting elements, these are electrically connected to one another within a foam part, so that only one electrical connection is routed to the outside.

The respectively specified numerical ranges also include—to the extent that these are not already specified by way of example—all intermediate values, specifically in particular restricted in 1/10 steps from the lower and/or upper limit to the respective other limit. In this case, "and" means that the two limits are displaced to the limit by in each case one or more tenths, that is to say are delimited.

The invention is explained in greater detail below with reference to be appended drawing which illustrates only three exemplary embodiments and in which.

Figure 1:
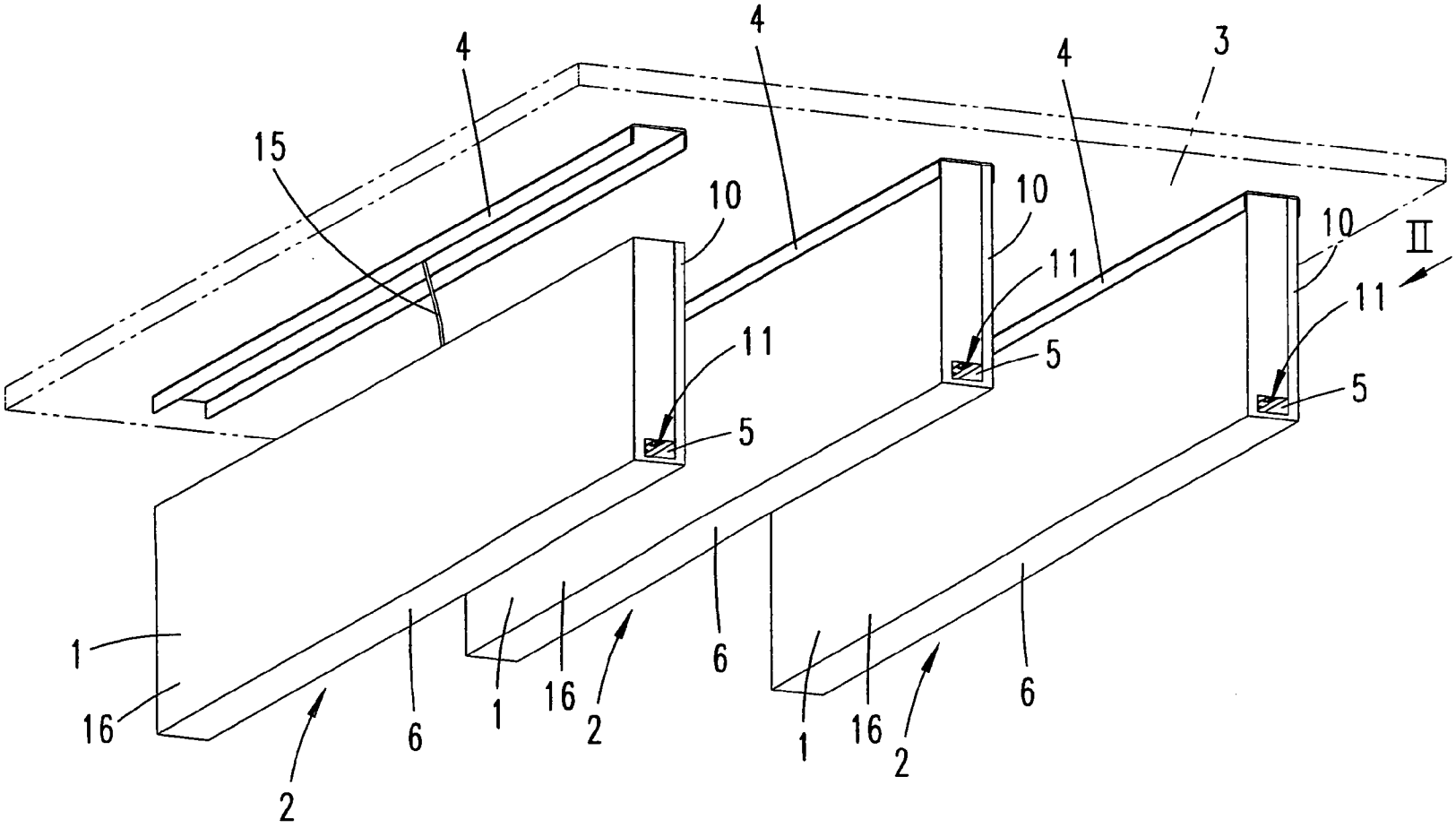
FIG. 1 shows a perspective illustration of foam parts of a first embodiment in suspended arrangement on a room ceiling.
Figure 2:
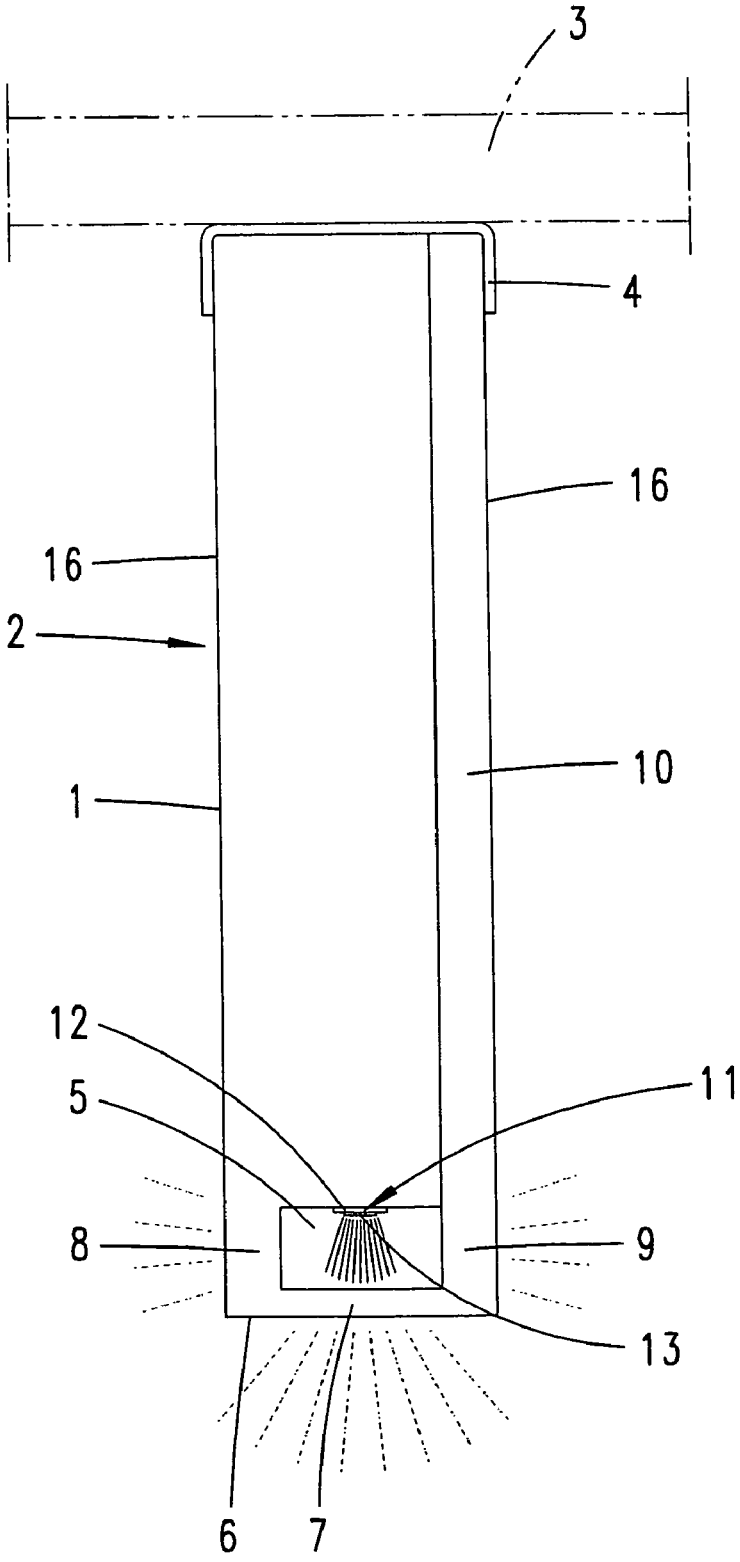
FIG. 2 shows the end view of a foam part according to arrow II in FIG. 1.
Figure 3:
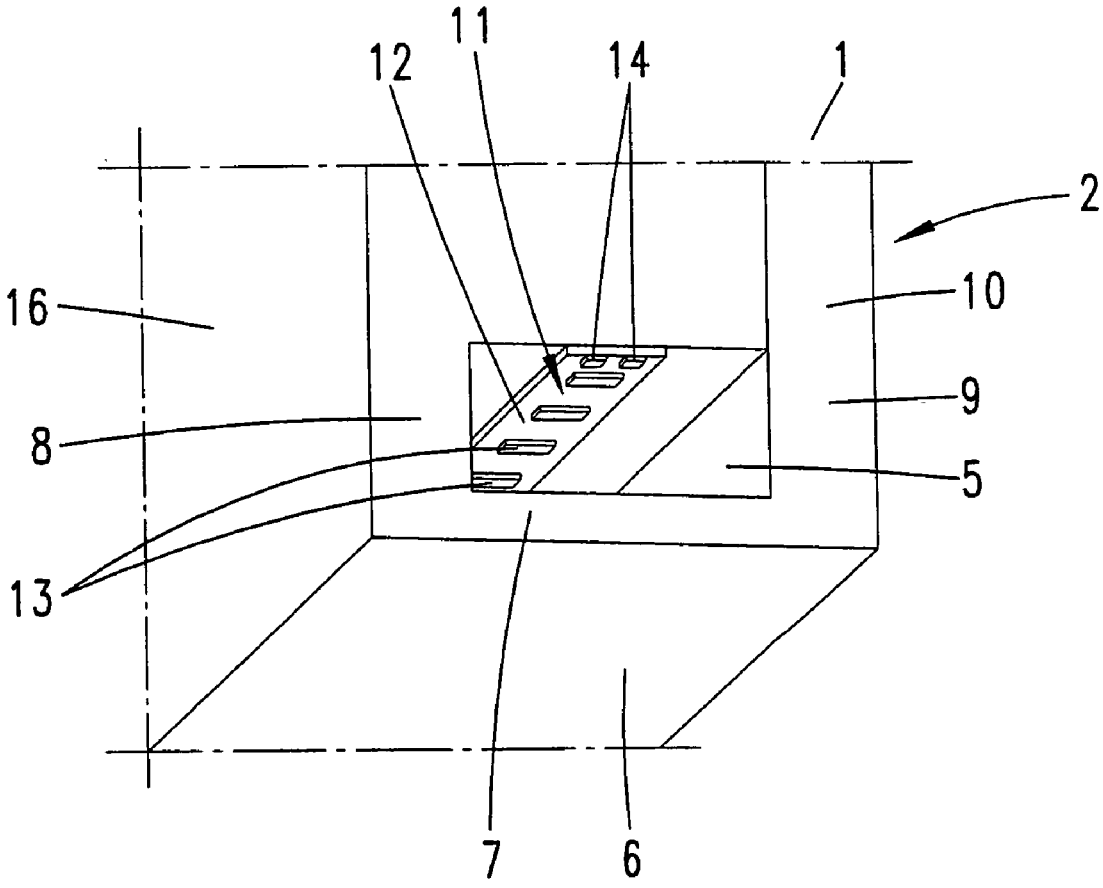
FIG. 3 shows a perspective detailed illustration of the region of the foam part which accommodates a lighting element.

A suspended arrangement of foam parts 1 on a room ceiling, relating to a first embodiment, is illustrated and described in first instance with reference to FIG. 1. These foam parts 1 serve as sound absorbers 2 and comprise an open-cell foam, preferably an open-cell melamine resin foam.

Each foam part 1 is of elongate form with an elongated rectangular cross-section, the longer limb defining the height of the foam part 1, as viewed perpendicular to the room ceiling 3, in cross-section.

Each foam part 1 has a length which corresponds to approximately 3 times the height. The thickness, as viewed transverse to the longitudinal extent, corresponds approximately to a quarter of the height of the foam part.

For the purpose of arrangement on the room ceiling 3, mounting rails 4 are mounted on the room ceiling. These mounting rails have a U-shaped cross-section, with the limb of the U which connects the arms of the U serving to fix the mounting rail 4 on the room ceiling 3. The arms of the U, which run parallel to one another, are spaced apart from one another by a distance which corresponds to the thickness of the foam part 1, so that the foam part 1 is held clamped by means of the arms of the U of the mounting rail 4 after the foam part 1 is inserted into the mounting rail 4.

The foam part 1 of the first embodiment has an accommodation space 5 of rectangular cross-section which is associated with the downwardly facing free end region. This accommodation space extends over the entire length of the foam part 1 and is open toward the perpendicular end faces of the foam part 1.

The accommodation space 5 is spaced apart from the downwardly facing end face 6 of the foam part 1 so as to leave a foam wall 7. This foam wall has a material thickness which, as viewed transverse to the width direction of the foam part 1, corresponds to one tenth of the width of the foam part, thus 5 mm for a width of the foam part of 50 mm in the illustrated exemplary embodiment.

As viewed in the width direction of the foam part 1, the accommodation space 5 is likewise flanked by foam walls 8, 9. The thickness of said foam walls corresponds approximately to one fifth of the foam width, thus approximately 10 mm in the illustrated exemplary embodiment.

In the illustrated exemplary embodiment, the height of the accommodation space 5, as viewed transverse to width of the foam part, corresponds to approximately 3 times the material thickness of the lower foam wall 7, thus further approximately 15 mm.

Figure 4:
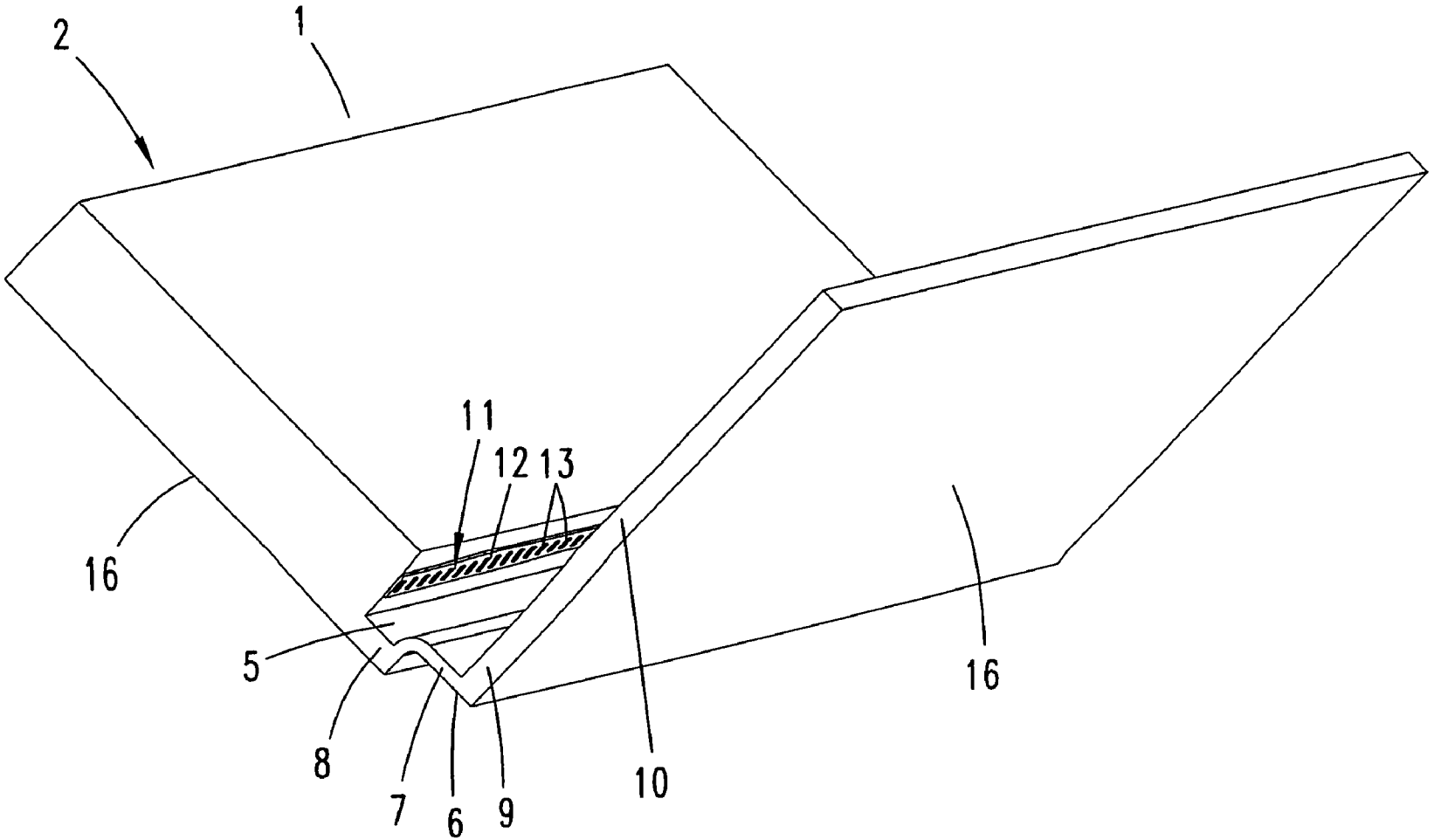
FIG. 4 shows a perspective individual illustration of the foam part with an associated lighting element, relating to a mounting position with the folding wall pivoted open.

The lateral foam wall 9 is part of a folding wall 10. This folding wall extends from and starts at the foam wall 7 which is associated with the end face 6 and as viewed in cross-section, while maintaining the material thickness of the wall 9 over the entire height of the foam part 1, and further also over the entire length of the foam part 1. Opening of the accommodation space 5 can be effected by pivoting-out the folding wall 10, pivoting-out of the folding wall 10 further being effected solely by the flexible configuration of the foam (cf., FIG. 4), with the folding wall 10 and foam part 1 being formed in one piece from the same material.

The closed position of the accommodation space, in which position the entire surface of the folding wall 10 rests on the facing broad face of the foam part 1, is ensured in the position in which the foam part is associated with the room ceiling 3 by the mounting rail 4 or by the associated arm of the U of the mounting rail 4.

A lighting element 11 is accommodated in the accommodation space 5. This lighting element can be inserted into the accommodation space 5 after the folding wall 10 is swung open and the accommodation space 5 is correspondingly opened.

In the illustrated embodiment, the lighting element 11 is an LED strip with a strip-like base support 12 which extends over the entire length of the accommodation space 5 and therefore over the entire length of the foam part 1. LEDs 13 which are uniformly spaced apart from one another in the longitudinal extent of the foam part 1 or of the base support 12 are disposed on the base body 12. These LEDs are electrically connected to one another on the base support 12. At each end, the base carrier 12 has contacts 14 for making electrical contact with further lighting elements 11 which are provided in downstream foam parts 1 or for connection of a power supply cable 15. In the illustrated embodiment, the lighting element 11 is mounted at the top of the accommodation space 5, that is to say with the LEDs 13 facing downward in the direction of the accommodation base.

In the operating state, the lighting element 11 accordingly illuminates the accommodation space 5 of the foam part 1 in such a way that the light shines through the outwardly facing, adjacent foam subregions (foam walls 7 to 9), this leading to diffuse illumination of the immediately surrounding region. In this case, in particular on the downwardly facing end face 6, regions which are immediately opposite the LEDs 13 and are therefore directly illuminated may appear brighter than adjacent, indirectly illuminated regions, so that a visually pleasing lighting pattern appears at least on the lower side of the foam part 1. In the regions of the side walls 16 of the foam part 1 which are directly associated with the accommodation space 5, a steady, diffuse band of light is produced, preferably in accordance with the material thickness of the foam wall 8 or 9 which is twice the thickness of the foam wall 7 that is associated with the end face 6 in this case.

Figure 5:
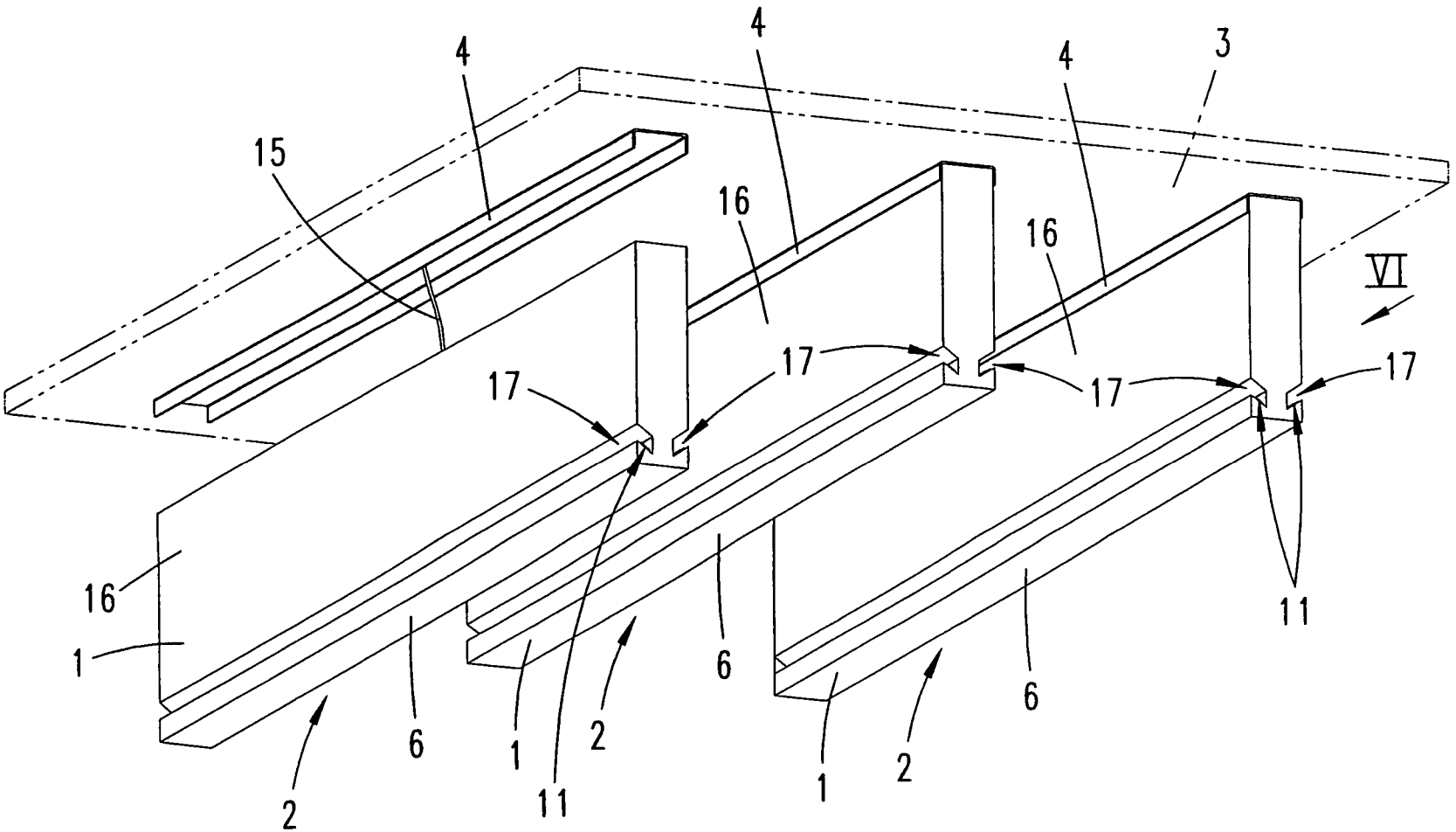
FIG. 5 shows an illustration corresponding to FIG. 1, but relating to a second embodiment of the foam part.
Figure 6:
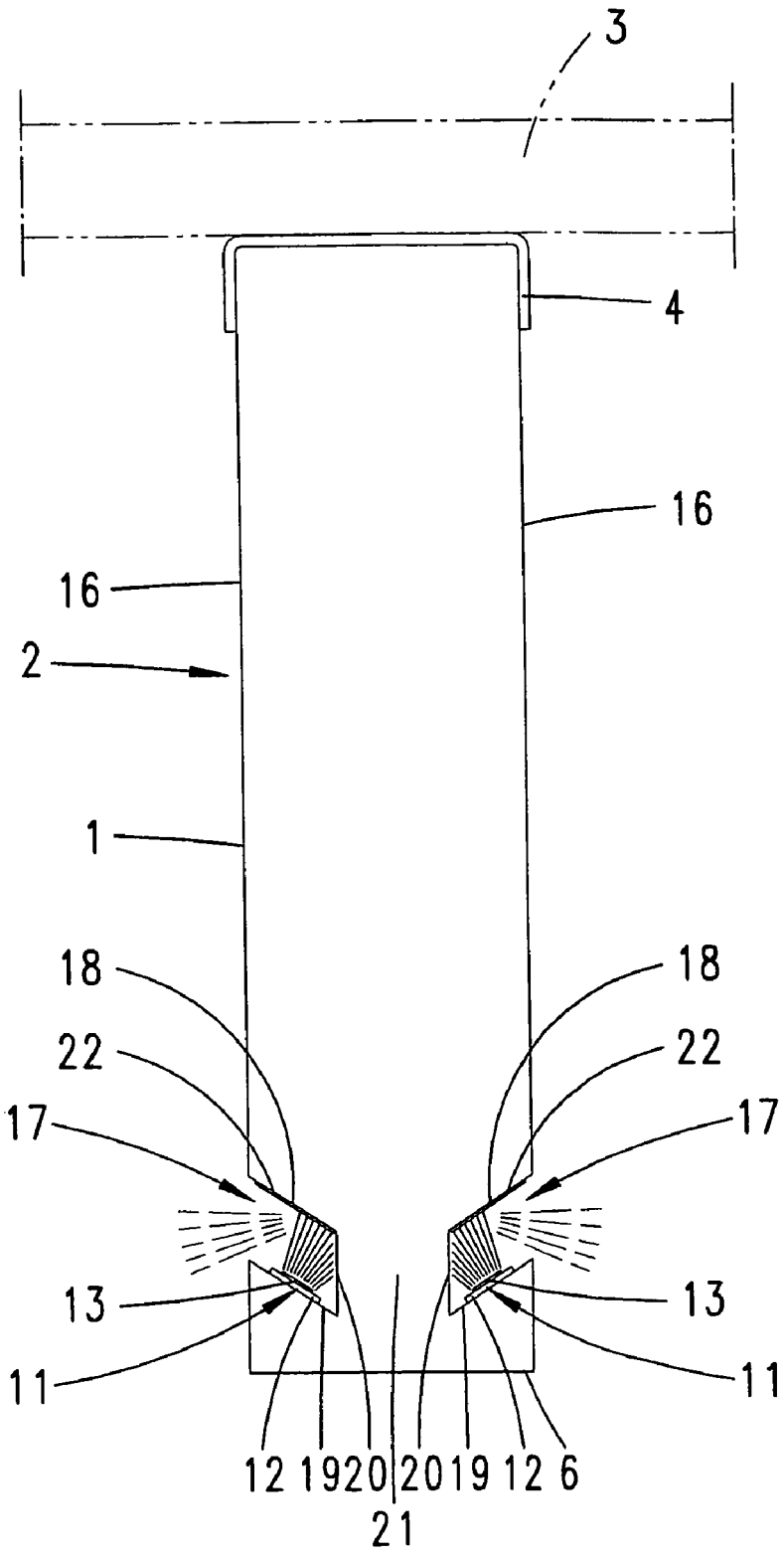
FIG. 6 shows the end view of the foam part of the second embodiment according to arrow VI in FIG. 5.
Figure 7:
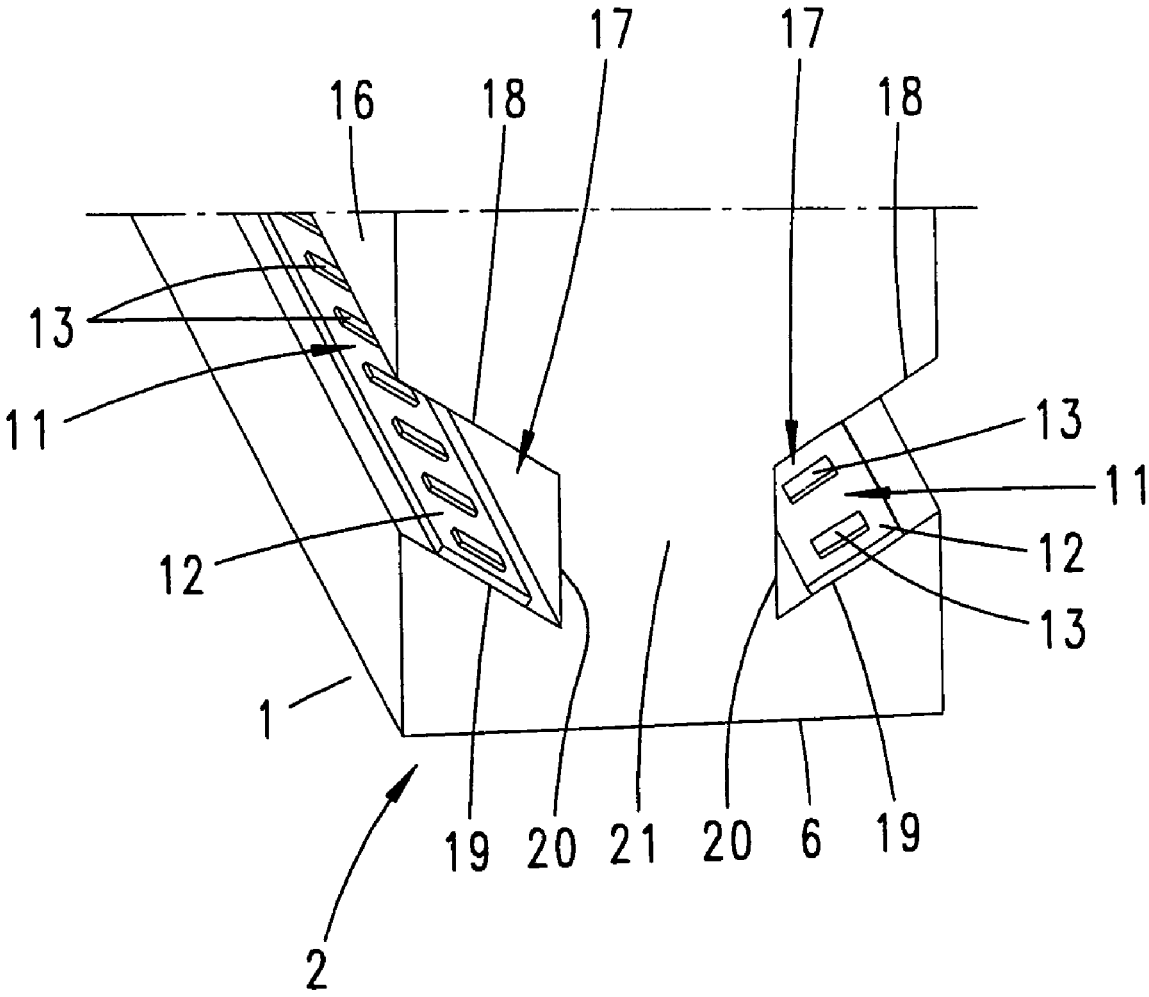
FIG. 7 shows a perspective detail illustration which corresponds to FIG. 4 and relates to the second embodiment.

FIGS. 5 to 7 show a second embodiment of a foam part 1. This foam part 1 has a profiled portion 17 associated with the side walls 16 and further associated with the lower end face 6. This profiled portion is open at the edge, that is to say is formed to be open in the direction of the respective side wall 16, and extends over the entire length of the foam part 1 and opens toward the respective end faces.

The profiled portions 17 are disposed with mirror-image symmetry with respect to a vertical longitudinal plane of the foam part 1 and each has an undercut. Therefore, as viewed in cross-section, the top 18 of the profiled portion and the base 19 of the profiled portion which runs parallel to said top slope down, in relation to a plane which is oriented perpendicular to the vertical longitudinal plane and parallel to the lower end face 6, starting from the opening 20 in the side wall, inward in the direction of the end face 6, so as to leave a spacing from the end face 6 which corresponds to approximately one fifth of the width of the foam part.

The inner boundary of the profiled portion 17 is formed by a perpendicular rear wall 20, that is to say a rear wall which runs parallel to the associated side wall 16. In the illustrated exemplary embodiment, the distance between the rear walls 20, which run parallel to one another, of the two opposite profiled portions 17 corresponds to approximately two fifths of the width of the foam part. The central foam region remaining between the rear walls is denoted by the reference symbol 21.

A lighting element 11 in the form of an LED strip is provided in each profiled portion 17 or in each undercut. These lighting elements are each disposed on the profiled portion bases 19 and accordingly positioned obliquely in relation to a horizontal plane, so as to face inward.

The LEDs 13 of the lighting element 11, inclined to face inward, directly illuminate both the rear wall 20 and the top 18 of the profiled portion on account of this arrangement. By virtue of reflection, the light exits indirectly via the slot-like openings in the profiled portions 17 in the respective side wall. Furthermore, by virtue of reflection, the light also emerges diffusely through the lower end face 6 of the foam part 1, possibly also through the edge cross-pieces remaining beneath the profiled portions 17.

In the illustrated exemplary embodiment, the reflection through the slot-like openings to the outside is assisted by a reflection foil 22 which is disposed on the top 18 of the profiled portion, for example in the form of a laminated-on aluminum foil.

Figure 8:
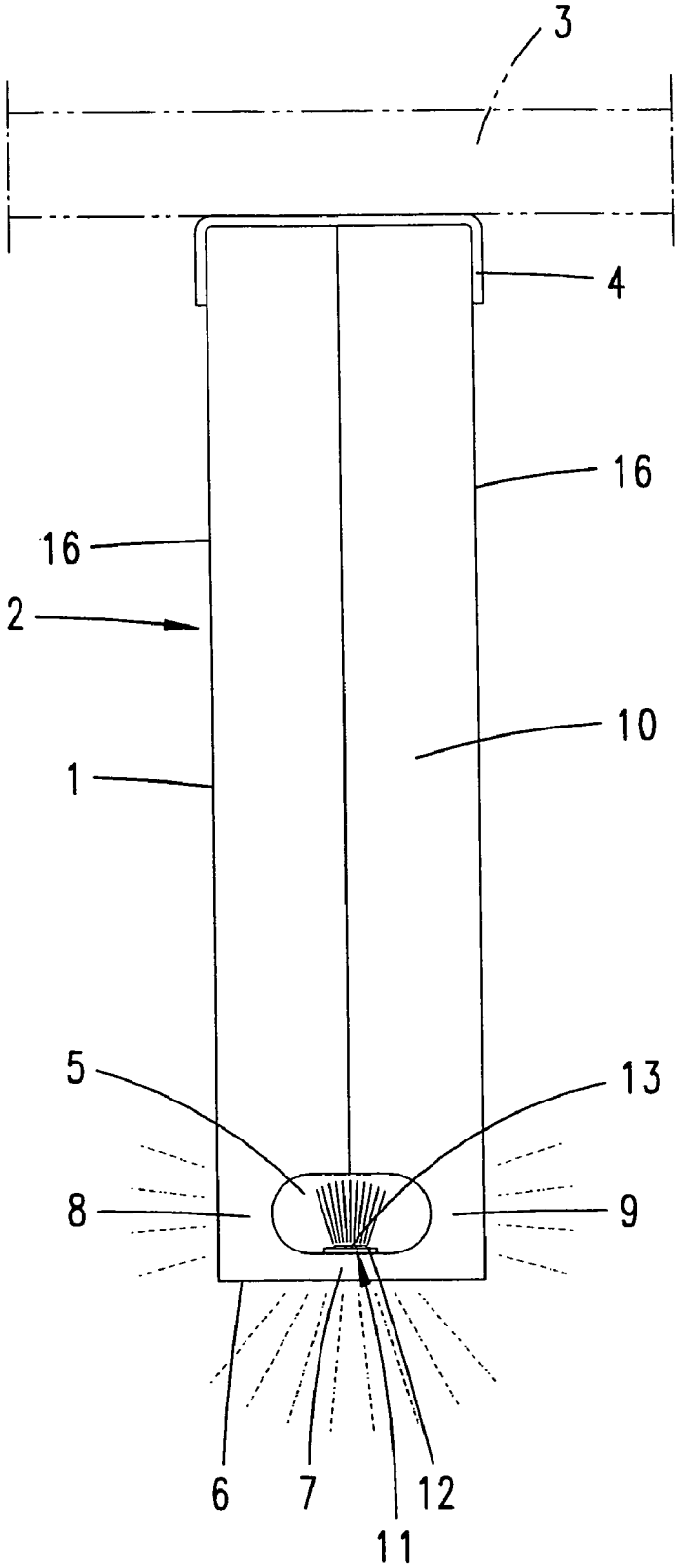
FIG. 8 shows an end view of a foam part in a third embodiment.

FIG. 8 shows a further embodiment of a foam part 1. This foam part 1 also has a lighting element 11 which is surrounded, in cross-section, on all sides by foam, in accordance with the first exemplary embodiment. This lighting element is situated in an accommodation space 5. The foam part 1 is divided along a vertical longitudinal plane, starting from the upper end face which is to be associated with the mounting rail 4, as far as the accommodation space 5, so that half of the foam part 1 represents a folding wall 10 for opening the accommodation space 5.

The above-described solutions describe foam parts 1 which serve both as a sound absorber 2 and as a light source. Therefore, foam parts 1 of this kind can also be used at the same time as path illumination means, for example to illuminate escape routes. In this case, indirect and/or diffuse illumination is always provided, so that a glare effect is counteracted.

All features disclosed are (in themselves) pertinent to the invention. The disclosure content of the associated/accompanying priority documents (copy of the prior application) is also hereby incorporated in full in the disclosure of the application, including for the purpose of incorporating features of these documents in claims of the present application.

LIST OF REFERENCE SYMBOLS

1 Foam part
2 Sound absorber
3 Room ceiling
4 Mounting rail
5 Accommodation space
6 End face
7 Foam wall
8 Foam wall
9 Foam wall
10 Folding wall
11 Lighting element
12 Base support
13 LEDs
14 Contacts
15 Power supply cable
16 Side wall
17 Profiled portion
18 Profiled portion top
19 Profiled portion base
20 Rear wall
21 Foam region
22 Reflection foil

The invention claimed is:

1. A foam part for suspended arrangement in a room, with an acoustic region of the foam part, which has an outer contour, being illuminated by a lighting element, wherein the lighting element is mounted on the foam part and is disposed within the outer contour of the foam part.

2. A sound absorber which is mounted in a suspended manner on a room ceiling or room wall and is based on a foam part, comprising a lighting element which is mounted on the sound absorber and illuminates a subregion of the foam part.

3. The foam part according to claim 1, wherein the lighting element is surrounded, in cross-section, on all sides by foam.

4. The foam part according to claim 1, wherein the foam is an open-cell foam.

5. The foam part according to claim 1, wherein a folding wall is formed on the foam part for the purpose of introducing the lighting element into the foam part.

6. The foam part according to claim 1, wherein the foam part has, in a region of the lighting element, a profiled portion, which extends back behind the outer contour, and wherein the lighting element is disposed within the profiled portion.

7. The foam part according to claim 1, wherein the profiled portion has an undercut.

8. The foam part according to claim 7, wherein the lighting element is disposed in a sunk-in manner as a result of the undercut.

9. The foam part according to claim 6, wherein the profiled portion has a reflection foil opposite the lighting element.

10. The foam part according to claim 1, wherein the lighting element comprises an LED.

11. The foam part according to claim 1, wherein the lighting element comprises an LED strip.

12. The foam part according to claim 1, wherein, relative to a vertical longitudinal plane, two lighting elements are provided, which are separated by a foam region.

13. The foam part according to claim 12, wherein the two lighting elements are disposed oppositely from one another.

* * * * *